US006824404B1

(12) United States Patent
Sugar

(10) Patent No.: US 6,824,404 B1
(45) Date of Patent: Nov. 30, 2004

(54) LIGHT SOCKET DEVICE

(75) Inventor: Michael A. Sugar, Skokie, IL (US)

(73) Assignee: Inliten, LLC, Northfield, IL (US)

( * ) Notice: Subject to any disclaimer, the term of this patent is extended or adjusted under 35 U.S.C. 154(b) by 0 days.

(21) Appl. No.: 10/244,342

(22) Filed: Sep. 16, 2002

Related U.S. Application Data

(60) Provisional application No. 60/322,647, filed on Sep. 17, 2001.

(51) Int. Cl.[7] ..... H01R 13/44
(52) U.S. Cl. ..... 439/135
(58) Field of Search ..... 439/135, 148, 439/468, 854, 960, 149; 362/294, 437, 377, 378, 123, 226, 375, 433

(56) References Cited

U.S. PATENT DOCUMENTS 2,580,359 A * 12/1951 Moineau ..... 362/353
2,719,908 A * 10/1955 Morrison ..... 362/363
4,022,323 A * 5/1977 Yamazaki ..... 206/419
4,804,343 A * 2/1989 Reedy ..... 439/854
5,572,819 A * 11/1996 Topinka et al. ..... 40/570
6,416,337 B1 * 7/2002 Fan ..... 439/135
6,481,875 B1 * 11/2002 Bryant ..... 362/437
6,502,962 B1 * 1/2003 Menke et al. ..... 362/294
2002/0123255 A1 * 9/2002 Kertesz ..... 439/135

* cited by examiner

*Primary Examiner*—J. F. Duverne
(74) *Attorney, Agent, or Firm*—Michael Best & Friedrich LLP

(57) ABSTRACT

A non-conductive socket device that fits within or over an empty light bulb socket when the socket is being shipped or stored. The socket device may comprise a first portion to provide a grip for handling the device and a second non-conductive portion to fittingly engage the light bulb socket. Indicia may be provided on the first portion for identifying the type of light bulb to be used in a particular socket.

9 Claims, 7 Drawing Sheets

MINI LIGHT

C7

C9

G30

G40

G50

EDISON STANDARD

EDISON 3.125" DIAM.

LIGHT SOCKET DEVICE

This application claims the benefit and priority of U.S. provisional patent application Ser. No. 60/322,647 filed Sep. 17, 2001.

FIELD OF THE INVENTION

This invention relates to a system and product for storing and shipping items that feature one or more light bulb sockets, such as strings of Christmas lights or other decorative lighting. It is particularly well adapted to help eliminate: (1) damage to light bulbs that may be caused during the shipment or storage of such items; and (2) the potential dangers created by stringing or otherwise using items that have empty light sockets.

BACKGROUND OF THE INVENTION

Countless products feature one or more light sockets and bulbs, particularly for holiday decorations. For example, holiday decorations that are sold with pre-installed light strings, such as those used as Christmas and seasonal decorations, feature numerous light sockets with bulbs arranged throughout the decoration. Such "pre-wired" items can be set up with minimal effort, making them particularly appealing to consumers who may have little time to decorate for holidays. Indeed, it is now very popular for Christmas trees and similar holiday decorative items to be ordered and shipped with strings of lights already installed (see FIG. 6*a*).

One problem encountered with such products is that pre-installed or pre-strung light bulbs often break if the bulbs are shipped or stored within the light sockets on the item. Such breakage wastes bulbs and creates safety hazards from the shards of broken glass. In addition, broken bulbs have to be replaced, a potentially hazardous and time-consuming task.

To prevent such breakage, it is often desirable to ship and store light bulbs in a separate protective container. When the product—for example, a pre-strung Christmas tree or other decoration—is subsequently set up for use, the bulbs are removed from their separate protective container and installed in their respective sockets on the pre-wired light string. When the product is to be shipped or stored again, the bulbs are removed from their sockets and once again placed in their protective container.

However, this approach has several drawbacks. For example, shipping or storing a light string or other decorative holiday ornament with empty sockets may expose consumers to the risk of accidental electric shock or electrocution. Even if adequately warned, some people will nonetheless still plug in the light string before installing all of the light bulbs, thereby creating the possibility that someone could be electrocuted by coming into contact with an exposed and electrically charged socket. This danger is especially acute in products where the light sockets are wired in parallel rather than in series, so that the full current (120 volts or more) of electricity will flow to each socket regardless of whether one or more bulbs in the string are burned out or missing.

Also, certain holiday decorations that include light sockets, such as artificial Christmas trees, wreaths and garlands, are made with metal components (such as wire branches). If these types of decorations are shipped or stored with empty sockets, there is a danger that when the decoration is plugged in, the metal component could come into contact with an exposed and electrically charged socket in the decoration and cause an electrical shock. This is particularly true of artificial trees, garlands or wreaths that are packed tightly in shipping cartons so that their branches or other components may bend or shift during handling or storage, and thereby come into contact with an empty light socket.

Another drawback is that bulbs often come in a variety of shapes and colors and are meant to be placed in specific sockets to achieve the best decorative effect. If bulbs are shipped or stored separately and not pre-installed in their correct sockets, it is often time consuming or difficult for consumers to determine which particular bulb should be installed in a particular socket.

Accordingly, there is a need for a device and system that will reduce the risk of electrocution when lights strings and other products having one or more light sockets are shipped and stored without light bulbs installed in the sockets. There is also a need for a device to guide consumers as to which light bulb should be installed in a particular socket to achieve the best, or desired, ornamental appearance.

SUMMARY OF THE INVENTION

The present invention meets these and other needs by providing an inventive socket device that can fit securely in or over an empty light socket when the socket is being shipped or stored. The inventive socket device is made from a non-conductive material and will therefore eliminate the risk of accidental shock to anyone handling an empty socket in which the inventive device has been installed. Thus, when combined with a protective light bulb container, the inventive socket device provides an improved system for shipping and storing light strings and other products having one or more light sockets.

In a preferred embodiment, the inventive socket devices are color coded or otherwise provided with indicia to facilitate installation of the light bulbs in a particular predetermined design or configuration, matching the colored light bulbs to designated sockets so as to create a desired pattern. For example, a plurality of different-colored socket devices can be preinstalled in a string of lights in a desired configuration so as to let a consumer know which colored bulb should go in which socket: a red socket device would indicate a socket in which a red bulb should be installed, a blue socket device would indicate a socket in which a blue bulb should be installed, etc. In this system, a pre-designed desired decorative or ornamental effect can be achieved by a consumer with relatively minimal time and effort.

As an added advantage, the inventive socket device can also be used as a decorating accessory. For example, if, for decorative effect, a consumer does not wish to use a light bulb in every socket in a light string, socket devices can be used to fill the unused sockets so that less than the full amount of light bulbs can be used without creating any risk of electrical shock while maintaining the desired ornamental effect without unsightly empty sockets.

DETAILED DESCRIPTION OF THE PREFERRED EMBODIMENTS

In general, the present invention comprises a non-conductive socket device 5, that is shaped to fit securely in or over an empty light socket. For illustrative purposes, the present invention is described herein in connection with a C9 style socket. However, it should be understood that the present invention can be made for use in connection with all types of light bulb sockets, including, but not limited to, C6, C7, C9, and Edison style sockets. It will be readily apparent to those skilled in the art how to adapt the examples and teachings herein for use with these and other types of light sockets.

The present inventive device can be made from any suitable non-conductive material, including, but not limited to, rubber, polyvinyl chloride, polypropylene, polystyrene, and polycarbonate. In the preferred embodiments described and illustrated herein, socket device 5 comprises polypropylene. Suitable molding techniques for manufacturing socket device 5 are well known in the art and need not be set forth herein.

Figure 1A:
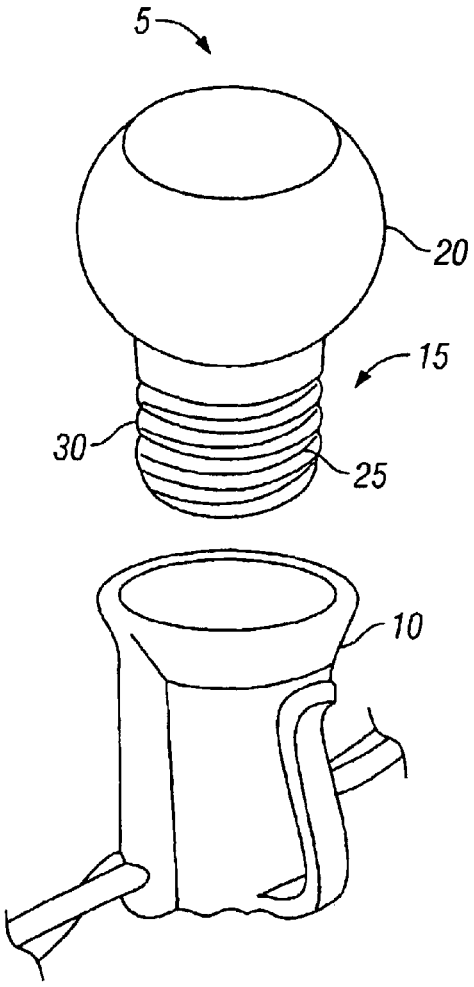
FIG. 1*a* is a perspective view of an embodiment of the present invention.
Figure 1B:
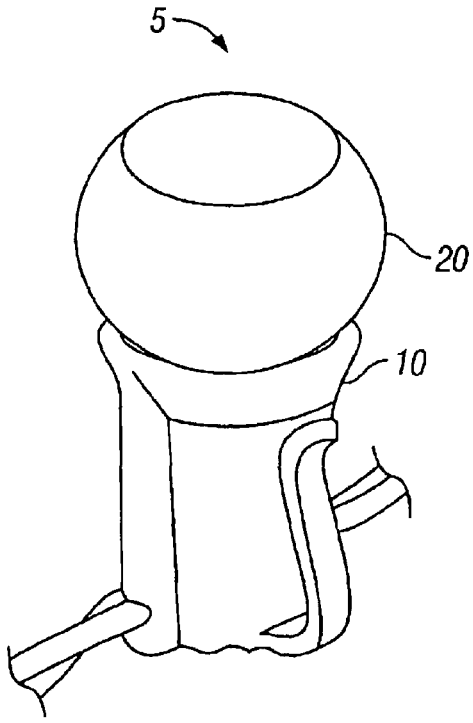
FIG. 1*b* is a perspective view of the inventive socket device of FIG. 1*a* installed in a light socket.

FIGS. 1*a,b* illustrate a preferred embodiment of the present invention in which socket device 5 is sized and shaped to be screwed into socket 10. In this embodiment, socket device 5 comprises a base 15 and a handle 20. Non-conductive handle 20 is shaped so as to provide a user with a means for gripping and handling the socket device 5. For illustrative purposes, handle 20 in FIGS. 1*a,b* is bulb-shaped, but any suitable shape can be used. Handle 20 is further provided with a flat surface to allow socket device 5 to rest stably on a table top or similar surface, without rolling around and becoming lost.

Base 15 is sized and shaped to fit snugly within socket 10, similar to the base of any light bulb sized to fit within the base. An outer thread 25 (again, like that which would be found on a suitably-sized light bulb) winds downwardly about the outer surface 30 of base 15 so that base 15 can be screwed into and out of socket 10. To install this style socket device, the device is screwed into the selected socket as a light bulb would be placed in the socket. To replace the socket device with a light bulb, the socket device is unscrewed and removed from the socket 10.

Figure 2A:
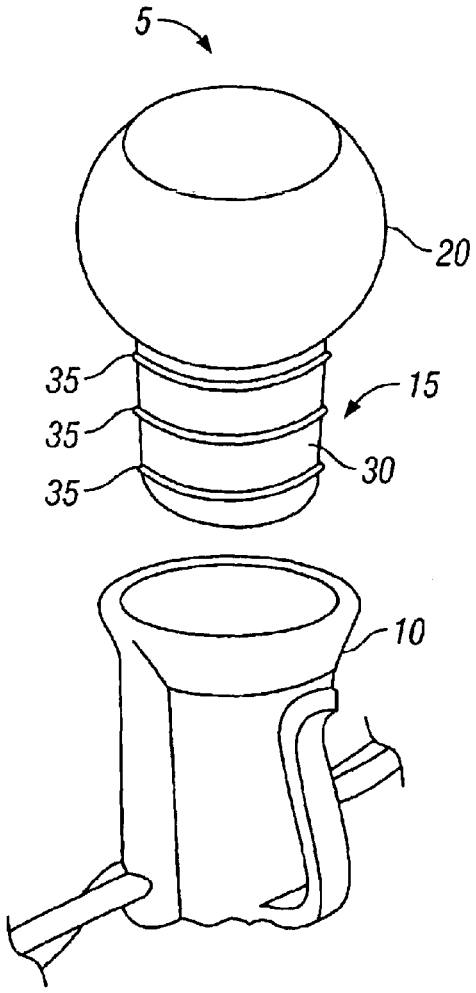
FIG. 2*a* is a perspective view of another embodiment of the present invention.
Figure 2B:
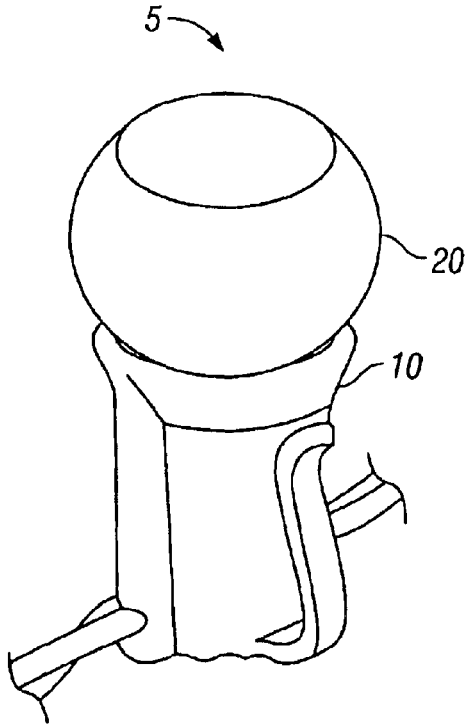
FIG. 2*b* is a perspective view of the inventive socket device of FIG. 2*a* installed in a light socket.

FIGS. 2*a,b* illustrate another embodiment of the socket device 5, in which a friction fit, rather than threads, is used to maintain the socket device 5 within socket 10. Like the threaded embodiment shown in FIG. 1*a*, this style of socket device features a base 15 and a handle 10. Unlike the base shown in FIG. 1*a*, however, the base 15 of this "friction fit" style socket device is not threaded. Rather, the base 15 shown in FIG. 2*a* features one or more flexible ridges 35 encircling the outer surface 30 of base 15.

The socket device is installed by pushing base 15 downward into socket 10. The friction between the ridges 35 and the interior surface of socket 10 will securely hold the socket device 5 within the socket 10. To replace this style socket device with a light bulb, a consumer grasps handle 20 and pulls the socket device out from the socket 10, exerting enough force to overcome the friction between ridges 35 and the interior surface of the socket 10.

Figure 3A:
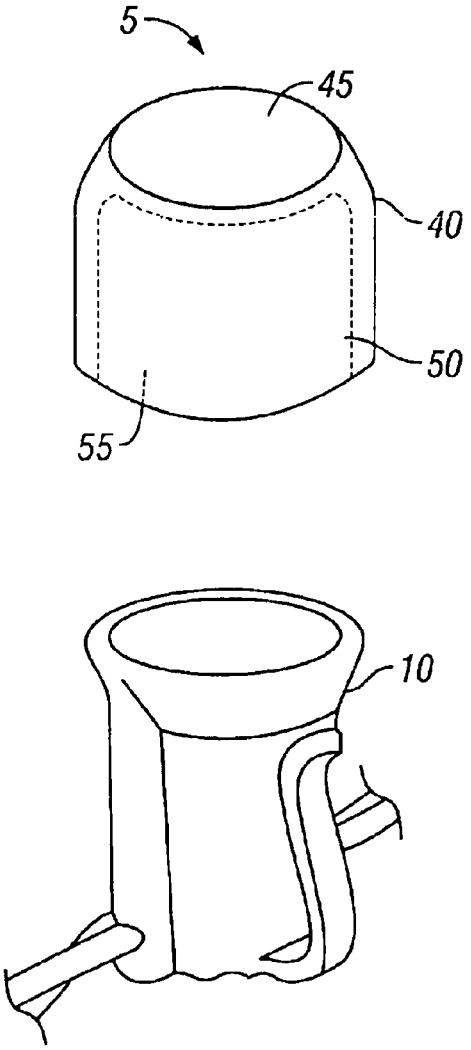
FIG. 3*a* is a perspective view of another embodiment of the present invention.
Figure 3B:
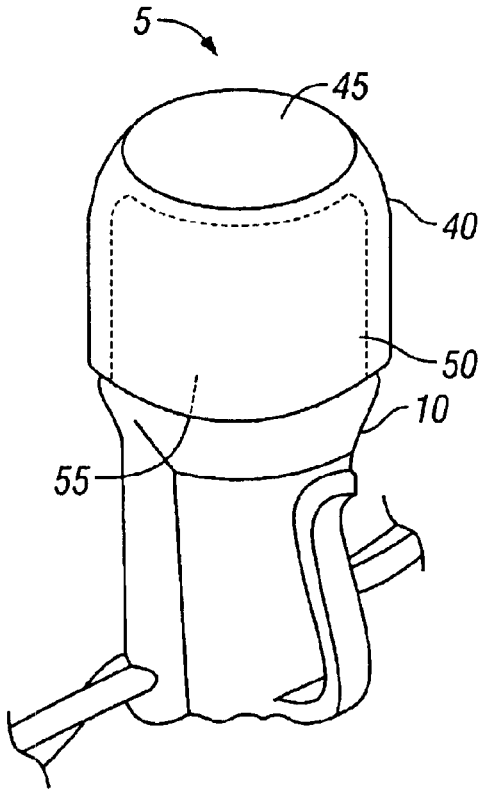
FIG. 3*b* is a perspective view of the inventive socket device of FIG. 3*a* installed in a light socket.

The present invention can also fit around and over, rather than within, a light bulb socket. FIGS. 3*a,b* illustrate yet another embodiment of the present invention in which socket device 5 comprises a non-conductive cover 40. In the illustrative embodiment shown in FIGS. 3*a,b*, cover 40 comprises a top wall 45 and a side wall 50 that define a cavity 55 shaped and sized to snugly fit over and receive socket 10.

To install this "cover" style socket device, socket 10 is placed within cavity 55, where the friction fit between the socket 10 and side wall 50 will keep the socket securely in place. To remove the socket 10 from the cavity 55, sufficient force is exerted on the plug 10 and/or the socket device to overcome the friction fit between the two parts.

Figure 4A:
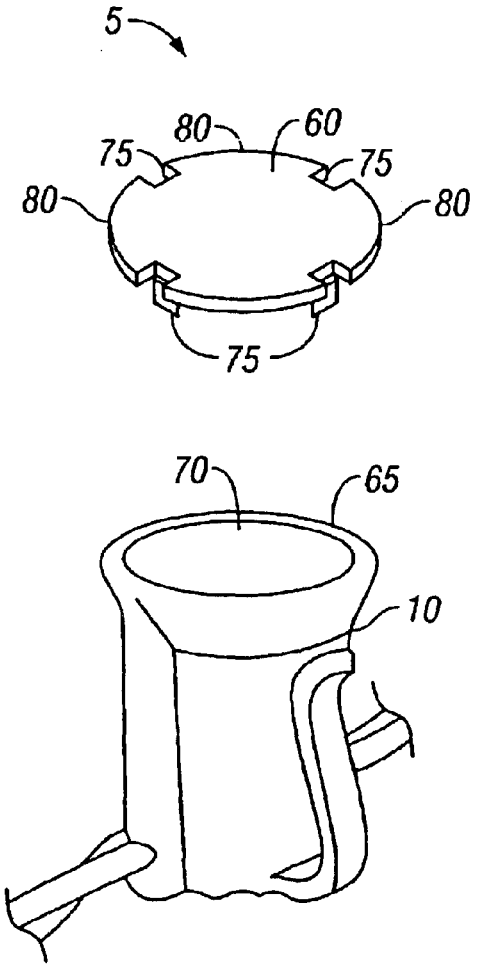
FIG. 4*a* is a perspective view of another embodiment of the present invention.
Figure 4B:
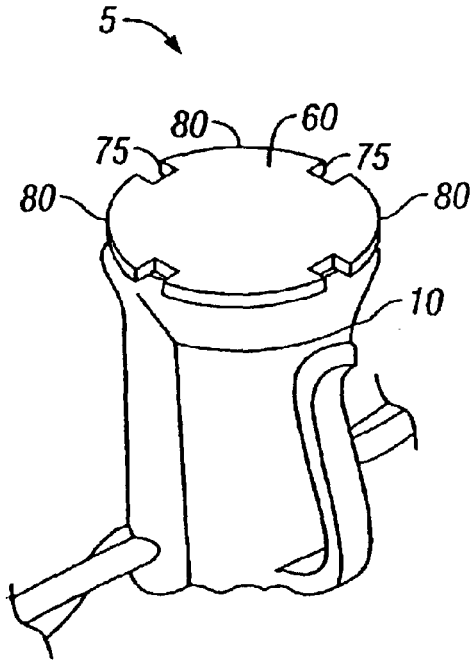
FIG. 4*b* is a perspective view of the inventive socket device of FIG. 4*a* installed in a light socket.

The inventive socket device 5 can also be designed so as only to cover the opening of socket 10. FIGS. 4*a*–*b* show an example of this embodiment, in which the socket device 5 comprises a non-conductive shield 60. Shield 60 is sized and shaped to fit snugly against the upper edge 65 of socket 10 and cover the opening 70 defined thereby. A plurality of flexible tabs 75 extend downwardly from the shield 60 and are positioned so as to fit snugly inside edge 65 when shield 60 is placed thereon and hold shield 60 in place by means of a friction fit.

Shield 60 can be readily removed from the socket by pulling it away from socket 10. Preferably, when shield 60 is installed on socket 10, the outer edges 80 of shield 60 extend beyond the upper edge 65 of socket 10, thereby providing a means to easily grip and otherwise manipulate the shield 60.

As discussed above, in a preferred embodiment, the inventive socket devices are color coded, labeled or otherwise provided with indicia to facilitate the installation of the light bulbs into pre-determined or selected sockets in order to create a pre-determined ornamental design. However, any type of suitable indicia can be used to indicate the appropriate installation of the light bulbs. For example, a plurality of different-colored socket devices can be preinstalled in a string of lights in a desired configuration or pattern so as to inform a consumer as to which colored bulb should go in which socket: a red socket device would indicate a socket in which a red bulb should be installed, a blue socket device would indicate a socket in which a blue bulb should be installed, etc. In another illustrative embodiment, labels such as "blue", "red", "C9" or "C30" can be placed on the socket devices to indicate which color or type of bulb should be used in a particular socket. Of course, the present invention does not require the use of any indicia such as color-coding, and could comprise the use of socket devices that are uniform in appearance and/or color.

Figure 5A:
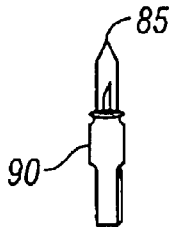
FIGS. 5*a*–5*h* depict the various light bulbs and light sockets with which the present invention can be used.
Figure 5B:
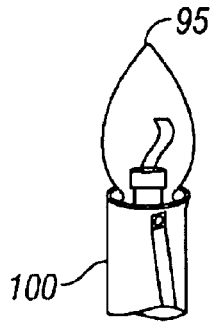
Figure 5C:
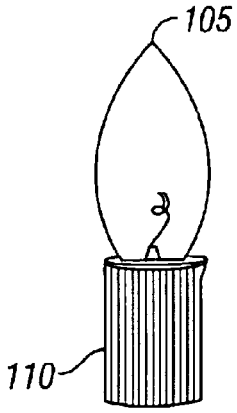
Figure 5D:
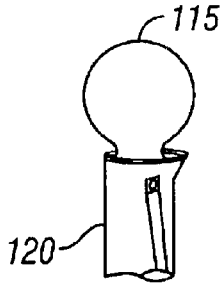
Figure 5E:
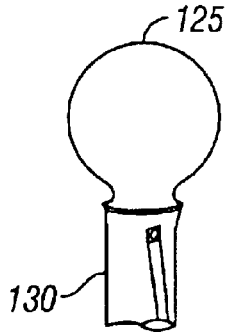
Figure 5F:
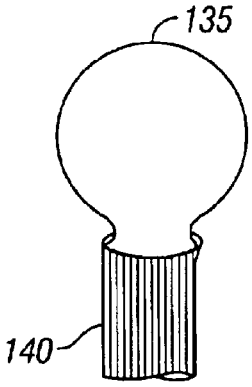
Figure 5G:
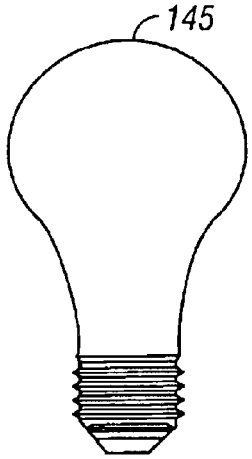
Figure 5H:
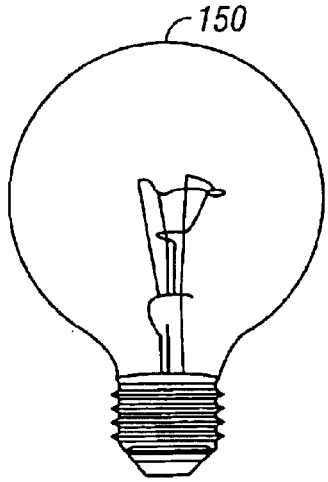

The inventive socket device described herein can be put to many uses. The socket device can be sized and shaped to fit any type of socket, including, but not limited to, those shown and used in connection with the different bulbs shown in FIGS. 5*a*–5*h*. FIGS. 5*a*–5*f* illustrate the following type of bulbs and sockets, respectively: mini bulb 85 and socket 90, C7 bulb 95 and socket 100, C9 bulb 105 and socket 110, C30 bulb 115 and socket 120, C40 bulb 125 and socket 130, and C50 bulb 135 and socket 140. FIGS. 5*g* and 5*h* illustrate a standard Edison style bulb 145 and a 3.125 inch diameter Edison bulb 150, respectively.

Figure 6A:
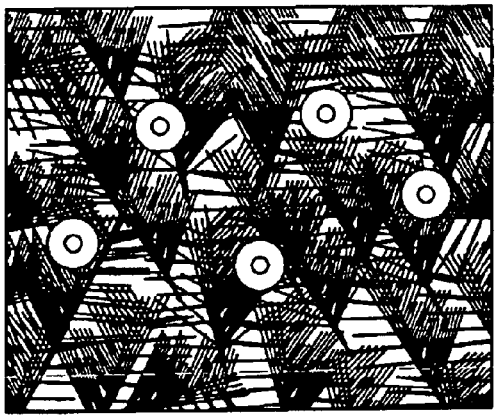
FIG. 6*a* depicts a pre-assembled, pre-wired Christmas tree with light bulb strings preinstalled thereon.
Figure 6B:
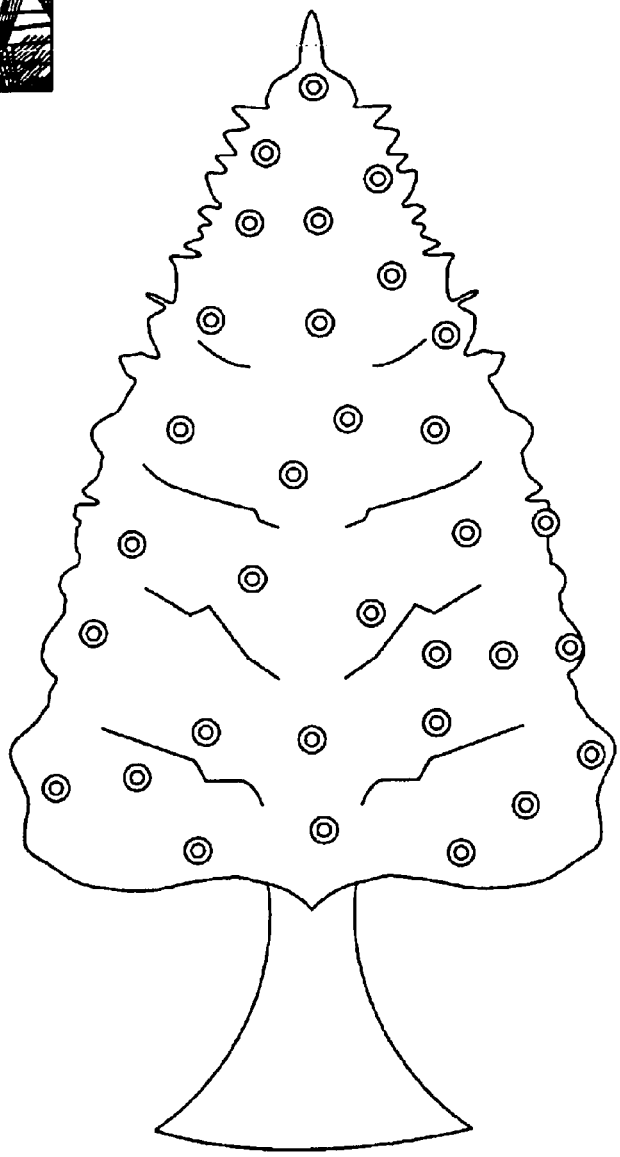
FIG. 6*b* is a detail view of the branches of the pre-assembled, pre-wired Christmas tree of FIG. 6*a;*
Figure 7:
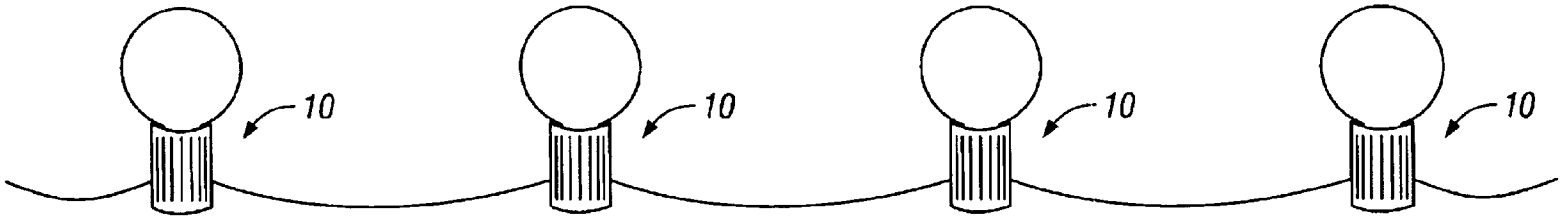
FIG. 7 depicts a light string with light bulbs installed therein.

Because the inventive socket device can be adapted to fit any type of socket, it can be used in connection with any product that features a light socket, such as a string of lights or other pre-wired lighted products and decorations. Such items typically come packaged with the decorative light bulbs installed so that purchasers can set up such pre-assembled decorations with relative ease in a minimum amount of time. For example, FIG. 6*a* shows a pre-assembled, prewired Christmas tree that is strung with C50 bulbs. FIG. 6*b* is a close-up of the pre-wired branches of the Christmas tree of FIG. 6*a*, showing the pre-installed C50 bulbs.

Figure 8:
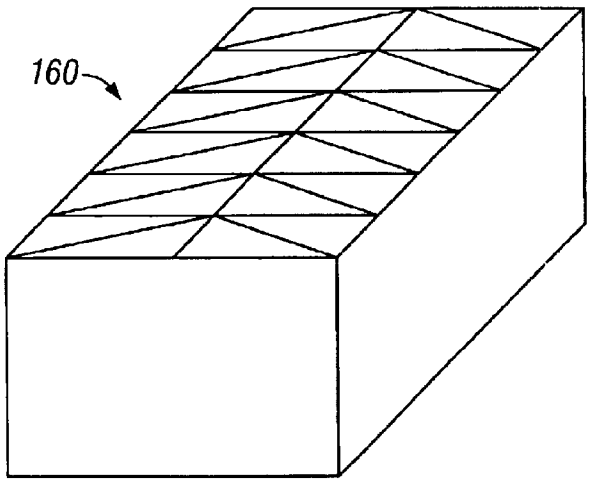
FIG. 8 is a perspective view of a carton for shipping and storing light bulbs for installation on a light string.

If a pre-assembled, pre-wired Christmas tree were shipped as shown in FIG. 6*a*, there would be a substantial likelihood that many of the pre-installed light bulbs would break during transit. To prevent breakage during transit or storage of the bulbs when the Christmas tree or other decoration is pre-wired, the bulbs are removed from the sockets and replaced with socket devices 5, such as, for example, the socket devices 5 shown in FIGS. 1–4. The pre-assembled tree can then be safely shipped, such as in carton 160 (FIG. 8), with strings of light bulbs pre-installed thereon and the bulbs shipped separately and safely within a protective container (not shown). Use of socket devices 5 in this manner during shipment will also lessen the risk of electrocution during the later handling of light sockets and light bulb strings during installation and use, and will make it easier to determine which bulbs should be placed in which sockets. The present invention thus provides significant advantages over the prior art by preventing bulb breakage and providing an easy-to-follow and quick system for installing lighted decorations and other similar items.

There has been described, with reference to specific exemplary embodiments thereof, a product display and dispensing system. It will be apparent to those skilled in the art that modifications may be made without departing from the spirit and scope of the invention. All modifications are considered within the sphere, spirit, and scope of the invention described herein. The specification and drawings, therefore, are to be regarded in an illustrative rather than restrictive sense.

What is claimed is:

1. A socket device comprising:

a first portion shaped to provide a grip for handling said socket device;

a second portion made of non-conductive material to fittingly engage a light bulb socket; and an indicia on said first portion that identifies the type of light bulb used in said light bulb socket; and a plurality of light bulb sockets for use with at least two different light bulbs arranged in a pre-determined sequence, said indicia identifying the light bulb in said predetermined sequence.

2. The socket device of claim 1, wherein said indicia is the color of said first portion and identifies the color of the light bulb in said pre-determined sequence.

3. The socket device of claim 1, wherein said non-conductive material is selected from the group consisting of rubber, polyvinyl chloride, polypropylene, polystyrene, polycarbonate and combinations thereof.

4. The socket device of claim 1, wherein said second portion is adapted to fit a light bulb socket selected from the group consisting of mini bulb, C6, C7, C9, C30, C40, C50 and Edison type sockets.

5. The socket device of claim 1, wherein said second portion is threaded to screw fit within said light bulb socket.

6. The socket device of 1, wherein said second portion is adapted to friction fit within said light bulb socket.

7. The socket device of claim 1, wherein said second portion is adapted to fit over said light bulb socket.

8. The socket device of claim 1, wherein said first portion has a flat surface for supporting said socket device.

9. The socket device of claim 1, wherein said first portion is a shield covering the opening of said light bulb socket and said second portion comprises at least one flange for engaging said light bulb socket.

* * * * *